United States Patent [19]

Dow et al.

[11] Patent Number: 5,054,826

[45] Date of Patent: Oct. 8, 1991

[54] COMPARTMENT LATCH REMOTE RELEASE WITH FOLDING MEMBER FOR DISABLING THE REMOTE RELEASE

[75] Inventors: Ian J. Dow, Royal Oak; David Kowalczyk, Sterling Heights; Carl D. May, Farmington Hills; Charles M. Wilson, Westland, all of Mich.

[73] Assignee: General Motors Corporation, Detroit, Mich.

[21] Appl. No.: 650,273

[22] Filed: Feb. 4, 1991

[51] Int. Cl.[5] ..... F05C 3/26

[52] U.S. Cl. ..... 292/125; 292/DIG. 43; 292/225; 292/DIG. 27

[58] Field of Search ..... 292/125, 216, DIG. 43, 292/DIG. 14, DIG. 27, 336.3, 225

[56] References Cited

U.S. PATENT DOCUMENTS

| | | | |
|---|---|---|---|
| 3,113,447 | 12/1963 | Oishfi | 292/DIG. 43 |
| 3,305,258 | 2/1967 | Peters | 292/198 |
| 3,572,790 | 3/1971 | Kapanka | 292/125 |
| 4,045,064 | 8/1977 | Okada | 292/DIG. 14 |
| 4,312,197 | 1/1982 | Carrion et al. | 292/DIG. 25 |
| 4,752,092 | 6/1988 | Faust | 292/DIG. 14 |
| 4,962,955 | 10/1990 | Ferrara et al. | 292/199 |

*Primary Examiner*—Eric K. Nicholson

*Attorney, Agent, or Firm*—Charles E. Leahy

[57] ABSTRACT

The vehicle has a luggage compartment panel which carries a latch engageable with a striker mounted on the vehicle body. A release trigger carried by the latch is positioned near the striker when the latch engages the striker. An actuator member is movably mounted on the striker and has an actuator arm extending into proximity with the trigger. A remote release handle mounted in the operator compartment is connected to the actuator member so that operator actuation of the release handle moves the actuator member relative the striker to carry the actuator arm into engagement with the trigger and actuate the trigger to unlatch the latch. A hinge is interposed in the actuator member by which the operator may fold the actuator member to a folded condition removing the actuator arm from proximity with the release trigger so that operator actuation of the remote release handle moves the actuator member without releasing the latch.

4 Claims, 6 Drawing Sheets

COMPARTMENT LATCH REMOTE RELEASE WITH FOLDING MEMBER FOR DISABLING THE REMOTE RELEASE

The invention relates to a remotely releasable latch for a vehicle luggage compartment panel and more particularly provides a foldable actuator member having an unfolded position connecting the remote release handle with the latch and a folded position disconnecting the remote release handle from the latch.

BACKGROUND OF THE INVENTION

Motor vehicles typically have a latch for latching a luggage compartment panel. The latch is released by a key cylinder to open the panel and permit access to the luggage compartment.

It is also known to provide a remote handle adjacent the operator's seat and connected to the latch by a cable. Lifting the handle pulls the cable and thereby releases the latch from inside the vehicle so that the compartment panel springs to the open position.

One disadvantage of the aforedescribed remote release for the compartment panel is that a person who has entry to the occupant compartment, such as a valet parking attendant, also has access to the luggage compartment by operating the remote handle. Accordingly, the prior art has proposed a switching device located inside the luggage compartment by which the remote release handle may be disenabled from operation of the deck lid latch.

The present invention provides a new and improved remotely releasable deck compartment panel having a disconnect device for disenabling the remote release feature.

SUMMARY OF THE INVENTION

According to the invention the vehicle has a luggage compartment panel which carries a latch engageable with a striker mounted on the vehicle body. A release trigger carried by the latch is positioned near the striker when the latch engages the striker. An actuator member is movably mounted on the striker and has an actuator arm extending into proximity with the trigger. A remote release handle mounted in the operator compartment is connected to the actuator member so that operator actuation of the release handle moves the actuator member relative the striker to carry the actuator arm into engagement with the trigger and actuate the trigger to unlatch the latch. A hinge is interposed in the actuator member by which the operator may fold the actuator member to a folded condition removing the actuator arm from proximity with the release trigger so that operator actuation of the remote release handle moves the actuator member without releasing the latch.

Accordingly, the object, feature and advantage of the invention resides in the provision of a remotely actuated actuator member movably mounted on the striker and having an unfolded position in which the actuator member will engage and actuate a release trigger to unlatch the latch, and a folded position in which the actuator member is moved by the remote actuator but cannot engage with the release trigger to release the latch.

BRIEF DESCRIPTION OF THE DRAWINGS

These and other features, objects, and advantages of the invention will become apparent upon consideration of the description of the preferred embodiment and the appended drawings in which.

DESCRIPTION OF THE PREFERRED EMBODIMENT

Figure 1:
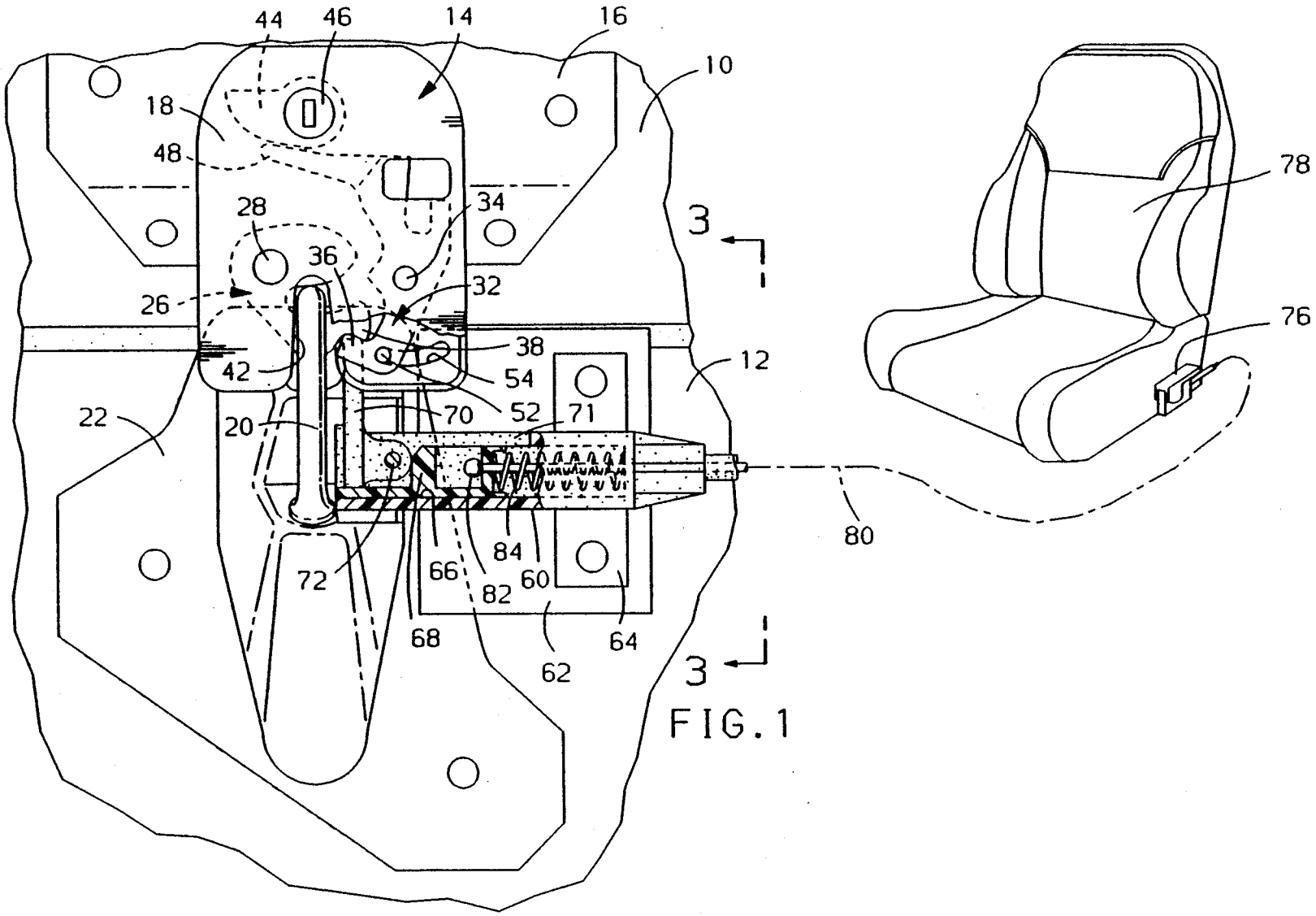
FIG. 1 is an elevation view of the compartment panel latch according to the invention and showing a vehicle seat having an associated remote actuator.
Figure 2:
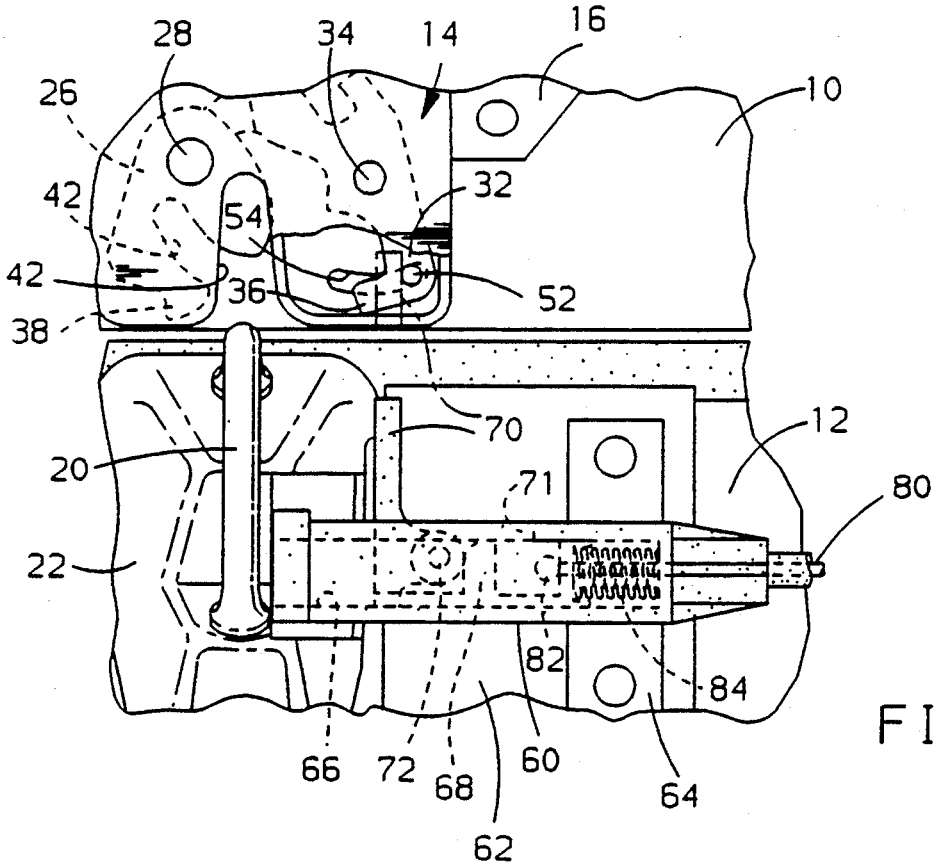
FIG. 2 is a fragmentary view of FIG. 1 showing the actuator member releasing the latch.
Figure 3:
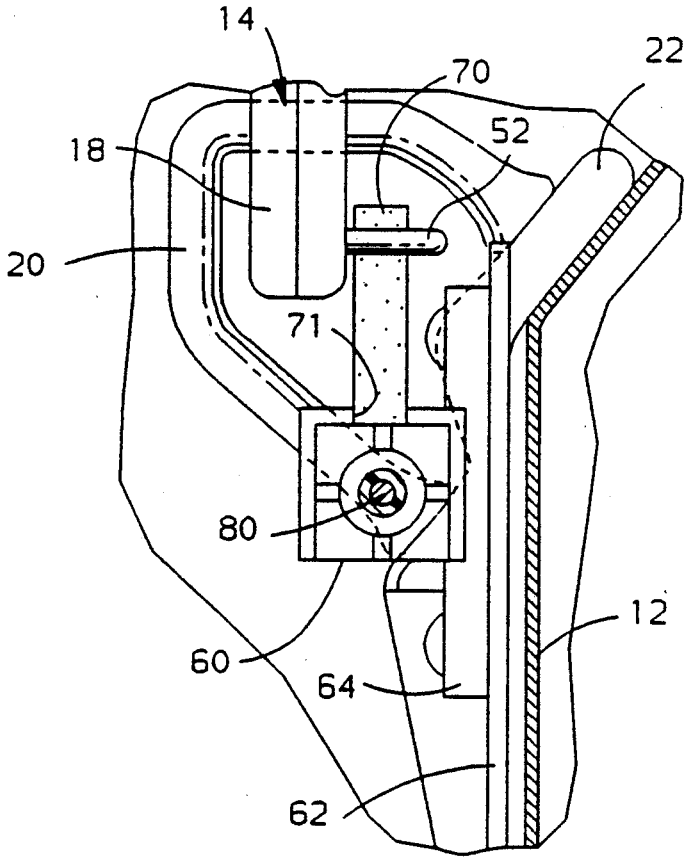
FIG. 3 is a section view taken in the direction of arrows 3—3 of FIG. 1.

Referring to FIG. 1, a compartment panel 10 is mounted on a vehicle body 12 by hinges, not shown. The compartment panel 10 is held in the closed position of FIG. 1 by a latch assembly 14 mounted on the compartment panel 10 by mounting bracket 16. A striker 20 is mounted on the vehicle body 10 by mounting bracket 22. The latch 14 includes a housing 18 and a latch bolt 26 mounted by a pivot 28 to capture the striker 20 and hold the compartment panel in the closed position of FIG. 1.

The latch 14 has a detent lever 32 pivotally mounted on the latch housing 18 by a pivot 34. FIG. 1 shows the detent lever 32 in its latched position in which a hook portion 36 of the detent lever 32 engages a hook portion 38 of the latch bolt 26 to retain the latch bolt 26 at the latched position of FIG. 1. The housing 18 of the latch has a cut out 42 which admits the striker 20 into the latch housing 18 for engagement by the latch bolt 26.

The latch 14 may be unlatched from the striker 20 by a cam member 44 which engages a release arm 48 of the detent lever 32. The cam 44 is rotated by inserting a properly bitted key into a key cylinder 46, to rotate the key cylinder 46 and the cam 44. Rotation of the release cam 44 rotates the detent lever 32 which to thereby disengage the hook portion 36 from the hook portion 38 of the latch bolt 26.

The latch can also be unlatched by actuation of a release trigger pin 52 which projects laterally from the detent lever 32 and rides in a slot 54 provided in the latch housing 18. A remotely operated actuator mechanism is provided for operating the trigger pin 52. As shown in FIG. 1, a housing 60, preferably of molded plastic is mounted on the striker mounting bracket 22 by brackets 62 and 64. Housing 60 includes a bore 66 in which a slide member 68 is captured. An actuator arm 70 reaches through an open top slot 71 of the housing 60 and is hingedly connected to the slide member 68 by a pivot 72 so that the actuator arm 70 may be pivoted between the upright standing position of FIG. 1 and the horizontally folded position of FIG. 4.

A remote handle assembly 76 is mounted on the vehicle seat 78 and operates a push/pull cable 80 which is attached to the slide member 68 by a ball 82 swaged on the end of the cable 80. A coil compression spring 84 surrounds the cable 80 and acts between the housing 60 and slide member 68 to urge the slide member 68 leftwardly to a normal position of FIG. 1.

Referring to FIG. 1 it is seen that the actuator arm 70 extends into proximity with the trigger pin 52 of the latch assembly 14, and yet is spaced way from engagement therewith so that the latch 14 and compartment panel 10 are free to move between opened and closed positions as permitted by the unlatching and latching of the latch 14. If a vehicle occupant wishes to unlatch the compartment panel, the handle assembly 76 is actuated to retract the cable 80 which in turn pulls the slide member 68 rightwardly and causes the actuator arm 70 to engage with the trigger pin 52 and pivot the detent lever 32 out of engagement with the latch bolt 26 so that the latch 14 becomes unlatched.

Figure 4:
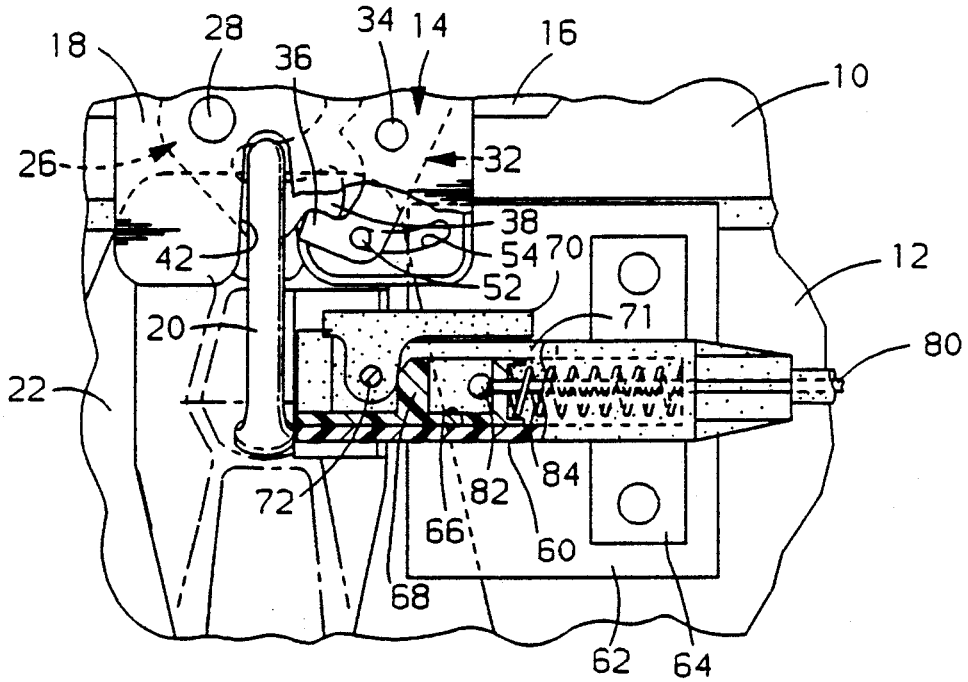
FIG. 4 is a view similar to FIGS. 1 and 2 but showing the actuator arm folded to prevent its engagement with the latch trigger upon remote operation of the actuator member.

If the vehicle operator wishes to disable the possible actuation of the latch 14 by the release handle 76, the operator manually pivots the actuator arm 70 rightwardly as viewed in FIG. 1 to the horizontal folded position of FIG. 4. The compartment panel 10 is then closed so that the latch 14 will again engage with the striker 20. Upon subsequent operation of the handle assembly 76, the cable 80 is retracted which in turn move the slide member 68 rightwardly from the FIG. 4 position. The folded actuator arm 70 will move rightwardly with the slide member 68 but will not engage with the trigger pin 52. Accordingly, whenever the actuator arm 70 is established in the horizontal folded position of FIG. 4, the actuation of the release handle 76 cannot unlatch the latch 14.

Figure 5:
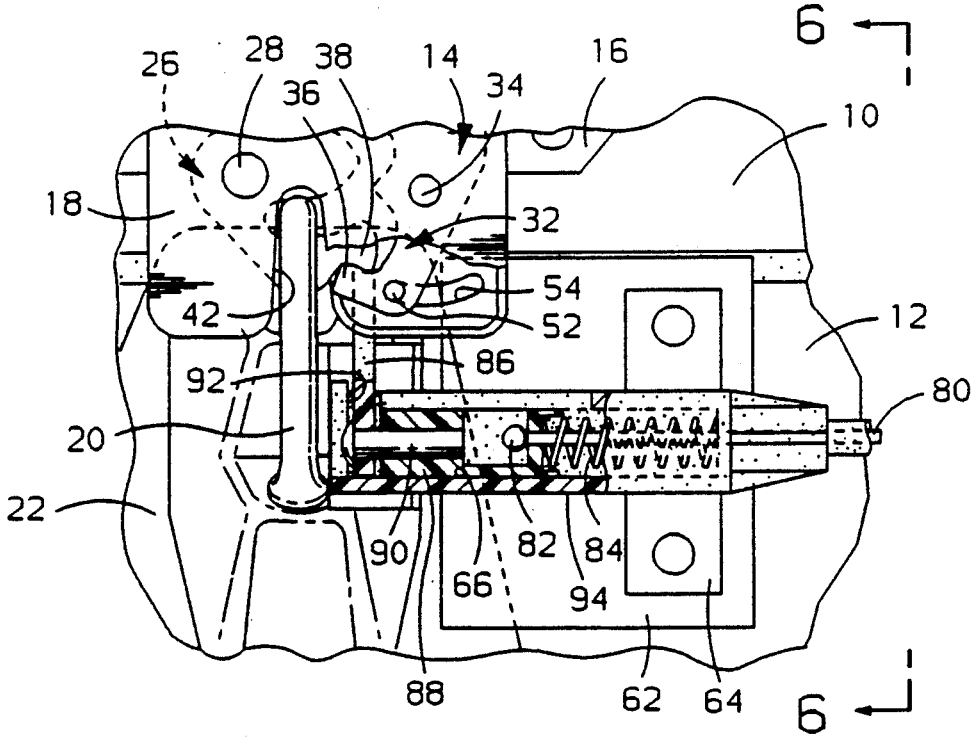
FIG. 5 is a view similar to FIG. 1 but showing a second embodiment of the invention.
Figure 6:
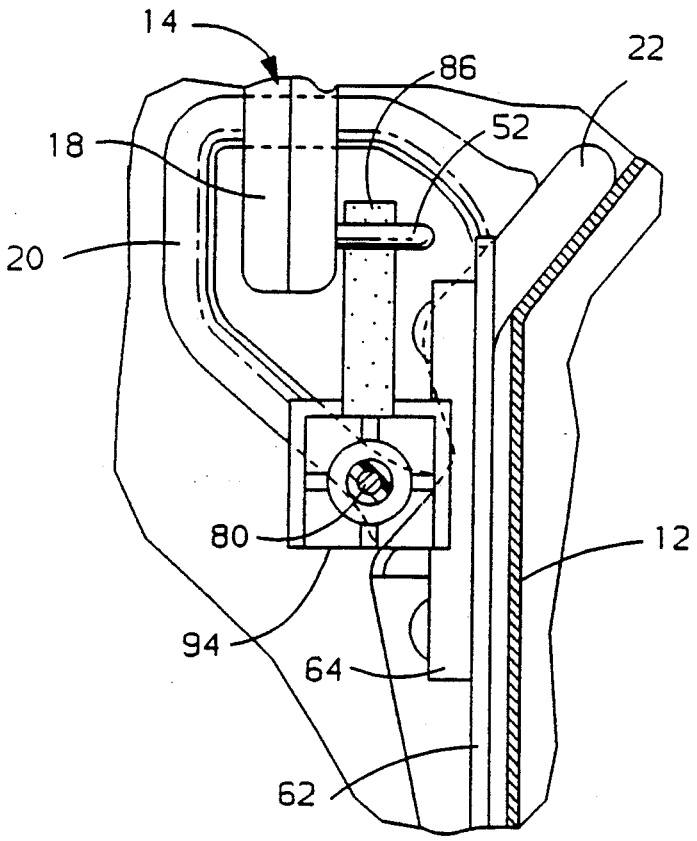
FIG. 6 is a sectional view taken in the direction of arrows 6—6 of FIG. 5.
Figure 7:
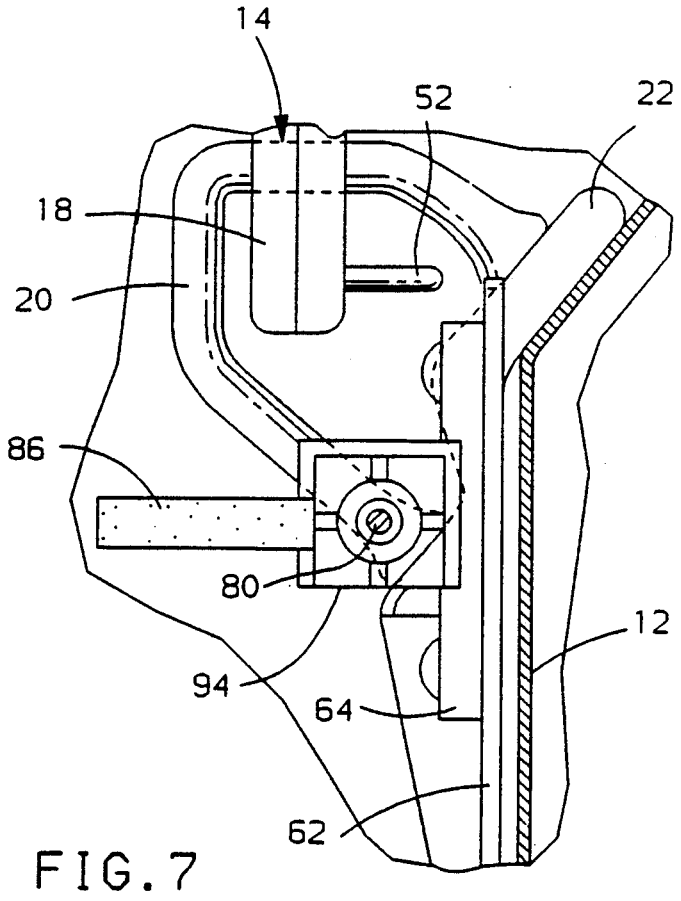
FIG. 7 is a view similar to FIG. 6 but showing the actuator arm folded to prevent engagement with the latch figure.

FIGS. 5, 6, and 7 show a second embodiment of the invention in which like elements are designated by like numerals. However, as seen in FIG. 5 the actuator arm designated by reference numeral 86, is attached to a slide member 88 by a pivot pin 90 so that the actuator arm 86 is pivoted to swing laterally from the vertical position of FIG. 6 to the folded position of FIG. 7 as permitted by side wall slot 92 in the housing 94. This removes the actuator arm 86 from proximity with the trigger pin 52. When the actuator arm is positioned in the vertical standing position of FIG. 5, actuation of the release handle 76 will retract the cable 80 and slide member 88 so that actuator arm 86 will engage trigger pin 52 to unlatch the latch 14. When the compartment panel 10 is in the opened position, the vehicle operator may fold the actuator arm 86 to the position of FIG. 7. Then, when the compartment panel 10 is again latched in the closed position, as shown in FIG. 7, an actuation of the release handle 76 cannot unlatch the latch because there cannot be any engagement between the actuator arm 86 and the trigger pin 52. Furthermore, as best seen with reference to FIG. 5, the slide member 88 and actuator arm 86 cannot be pulled rightwardly by the cable 80 because the arm 86 is captured in the side wall slot 92 of housing 60.

Figure 8:
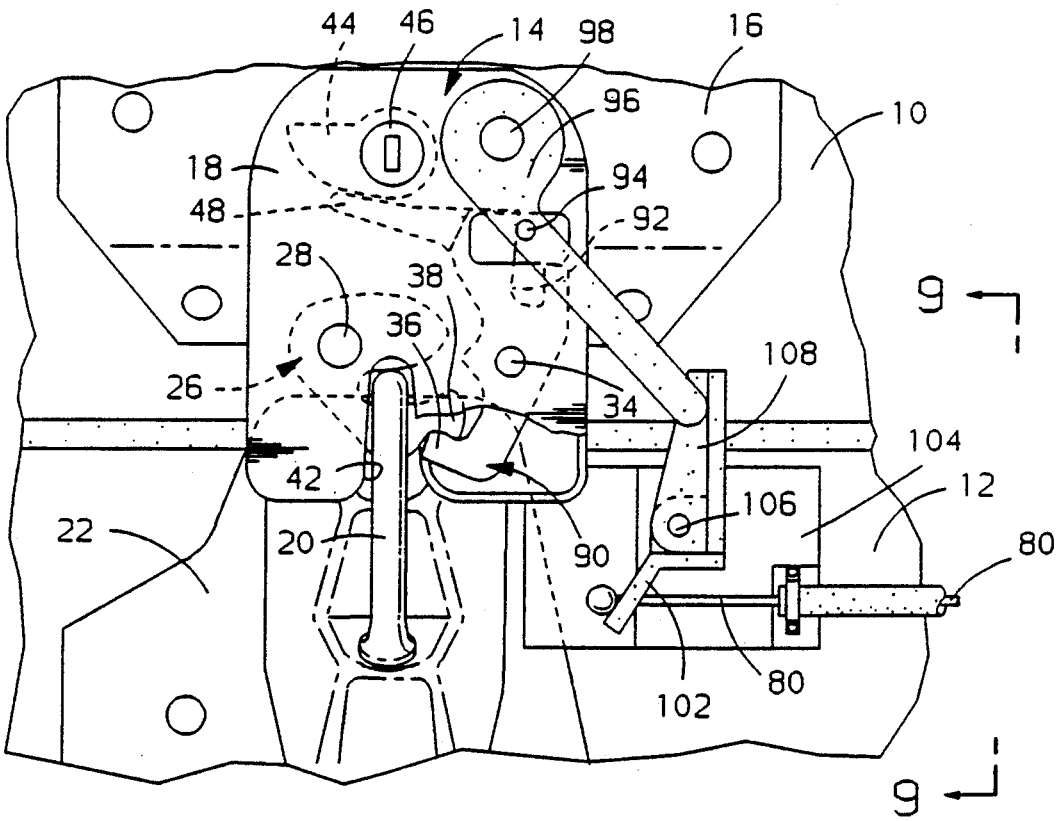
FIG. 8 is a view similar to FIG. 1 but showing a third embodiment of the invention.
Figure 9:
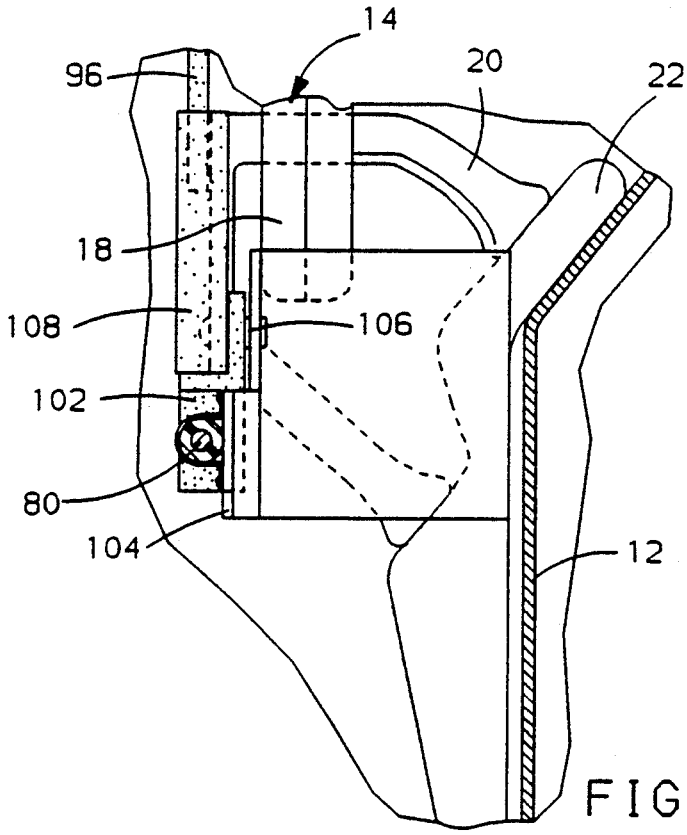
FIG. 9 is a sectional view taken in the direction of arrows 9—9 of FIG. 8.
Figure 10:
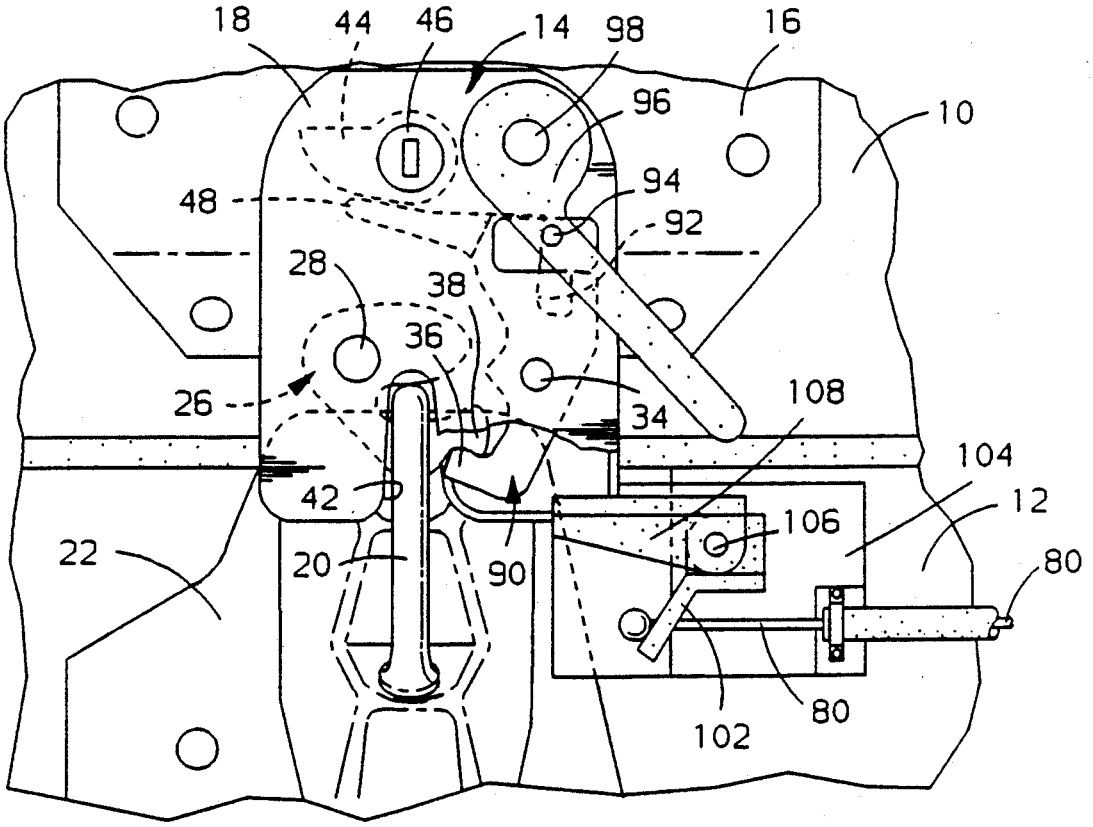
FIG. 10 is a view similar to FIG. 8 but showing the actuator arm folded to prevent engagement with the latch trigger.

Referring to FIGS. 8, 9 and 10, a third embodiment of the invention is shown and has like elements identified by numerals. Referring to FIG. 8, it is seen that the detent lever 90 has a slot 92 which captures a trigger pin 94 mounted on a trigger lever 96. The trigger lever 96 is mounted by a pivot 98 so that clockwise pivoting movement of the trigger lever 96 as viewed in FIG. 8 will cause the trigger pin 94 to pivot the detent lever 90 in the counterclockwise direction to release the latch bolt 26. An actuator member 102 is pivoted on a bracket 104 by pivot pin 106. An actuator arm 108 is also pivotally mounted on the pivot pin 106 and rests upon the actuator member 102 so that pivoting movement of the actuator arm 108 by cable 80 will pivot both the actuator member 102 and the actuator arm 108 in the counterclockwise direction. The actuator arm 108 pivots into engagement with the trigger lever 96 to rotate the trigger lever 96 and the trigger pin 94 which in turn releases the detent lever 90 to release the latch.

When the compartment panel 10 is opened, the vehicle operator may pivot the actuator arm 108 from the upstanding position of FIG. 8 to the horizontal folded position of FIG. 10. Accordingly, upon subsequent closure of the compartment panel 10, and retraction of the cable 80, the actuator member 102 and actuator arm 108 will rotate in unison. However, because the actuator arm 108 is folded, it cannot engage the trigger lever 96 so that the latch cannot be unlatched by operating the release handle 76.

Thus it is seen that the invention provides a new and improved remote release mechanism for a compartment panel latch.

The embodiments of the invention in which an exclusive property or privilege is claimed are defined as follows:

1. In a vehicle having a luggage compartment panel openable upon release of a latch from a striker, the improvement comprising:

a trigger carried by the latch and positioned near the striker when the latch engages the striker and holds the panel in the closed position, an actuator member movably mounted on the striker and having an actuator arm extending into proximity with the trigger, a remote release handle mounted in the operator compartment and operably connected to the actuator member so that operator actuation of the release handle moves the actuator relative the striker to carry the actuator arm into engagement with the trigger and actuate the trigger to unlatch the latch, and hinge means interposed in the actuator member by which the operator may fold the actuator member to a folded condition removing the actuator arm from proximity with the latch so that operator actuation of the remote release handle moves the actuator member without releasing the latch.

2. In a vehicle having a luggage compartment panel openable upon release of a latch from a striker, the improvement comprising:

a trigger carried by the latch and positioned in proximity to the striker when the latch engages the striker and holds the panel in the closed position, a housing associated with the striker, slide means slidably mounted on the housing, a remote release handle mounted in the operator compartment and operably connected to the slide means so that operator actuation of the release handle slides the slide means relative the striker, and an actuator arm pivotally mounted on the slide means for movement between an extending position in proximity with the trigger of the latch when the panel is closed so that operator actuation of the remote release handle sliding the slide means carries the actuator arm into engagement with the trigger and actuates the trigger to unlatch the latch, and a folded position removing the actuator arm from proximity with the latch so that operator actuation of the remote release handle moves the actuator without releasing the latch.

3. The combination of claim 2 further characterized by the housing having walls to define the path of sliding movement of the slide means and a slot in one of the walls permitting the actuator arm to reach therefrom into proximity with the trigger, and permitting slide means to slide within the housing even when the actuator arm is folded to the folded position.

4. In a vehicle having a luggage compartment panel openable upon release of a latch from a striker, the improvement comprising:

a trigger carried by the latch and positioned in proximity to the striker when the latch engages the striker and holds the panel in the closed position, a housing associated with the striker, an actuator member pivotally mounted on the housing, a remote release handle mounted in the operator compartment and operably connected to the actuator member so that operator actuation of the release pivots the actuator member relative the striker, and an actuator arm pivotally mounted on the actuator member for movement between an extending position in proximity with the trigger of the latch when the panel is closed so that operator actuation of the remote release handle pivoting the actuator member carries the actuator arm into engagement with the trigger and actuates the trigger to unlatch the latch, and a folded position removing the actuator arm from proximity with the latch so that operator actuation of the remote release handle moves the actuator member and actuator arm without releasing the latch.

* * * * *